US005887765A

United States Patent [19]

Broesamle

[11] Patent Number: 5,887,765

[45] Date of Patent: Mar. 30, 1999

[54] CAULK GUN

[75] Inventor: Donal R. Broesamle, Los Altos, Calif.

[73] Assignee: Dripless, Inc., Santa Rosa, Calif.

[21] Appl. No.: 905,212

[22] Filed: Aug. 1, 1997

Related U.S. Application Data

[60] Provisional application No. 60/024,111 Aug. 16, 1996.

[51] Int. Cl.[6] ..... B67D 5/42

[52] U.S. Cl. ..... 222/391; 74/141.5; 74/169

[58] Field of Search ..... 222/327, 391; 606/92, 93, 94, 95; 604/68, 71, 73, 181, 187, 207, 208, 209, 232, 233, 234, 282; 74/141.5, 169, 516, 522

[56] References Cited

U.S. PATENT DOCUMENTS 3,069,053 12/1962 Nilsson .
3,140,078 7/1964 Krahe et al. .
3,189,226 6/1965 Sherbondy .
4,009,804 3/1977 Costa et al. ..... 222/391
4,033,484 7/1977 Ornsteen .
4,081,112 3/1978 Chang .
4,461,407 7/1984 Finnegan .
4,572,409 2/1986 Finnegan ..... 222/391
5,529,225 6/1996 Chang ..... 222/391
5,653,363 8/1997 Chang ..... 222/391
5,788,126 8/1998 Chang ..... 222/391

*Primary Examiner*—Kenneth Bomberg
*Attorney, Agent, or Firm*—Henry M. Bissell

[57] ABSTRACT

A caulk gun is provided with a forward-biasing mechanism to maintain contact between the caulk tube and the piston rod. The forward biasing mechanism is of simple construction and is piggy-backed to the trigger housing of the caulk gun. The operation of the forward-biasing mechanism relies on a friction grip which surrounds the piston rod. This friction grip is urged in the forward direction by a spring contained within the housing of the forward-biasing mechanism, and thereby biases the piston rod in the forward direction, while relieving the back pressure inside the caulk tube.

16 Claims, 3 Drawing Sheets

CAULK GUN

CROSS-REFERENCE TO RELATED APPLICATION

This application claims the benefit of U.S. Provisional Application No.: 60/024,111, filed Aug. 16, 1996.

BACKGROUND OF THE INVENTION

1. Field of the Invention

The invention relates to hand-held material dispensing devices such as caulking guns.

2. Description of the Related Art

Hand-held material dispensing devices are well known in the art and generally rely on the action of a piston to push fluid out of a receptacle towards the application area. The motion of the piston is induced by the advancement of a piston rod in the direction of the receptacle, with the piston rod being advanced in the direction of travel by the operator's squeezing of a trigger in engagement therewith.

One such dispenser is shown in U.S. Pat. No. 3,140,078 to Krahe et al. The device of Krahe does not utilize a trigger, and is not concerned with biasing the piston rod in the forward direction.

Another fluid dispenser is disclosed in U.S. Pat. No. 4,461,407 to Finnegan. The Finnegan patent incorporates an automatic pressure release mechanism, but fails to address the forward biasing concerns with which the instant patent is concerned.

In U.S. Pat. No. 4,081,112 to Chang, there is disclosed a caulking gun having a forward-biasing spring to urge the trigger back to the cocked position after an application cycle. However, Chang does not make provisions for biasing the piston rod in the forward direction.

U.S. Pat. No. 4,033,484 to Ornsteen shows a hot melt adhesive gun which operates in the conventional manner of the prior art. However, the Ornsteen patent also fails to provide a forward-biasing mechanism for the piston rod to maintain contact of the piston with the fluid receptacle.

U.S. Pat. No. 3,069,053 to Nilsson and U.S. Pat. No. 3,189,226 to Sherbondy each show a caulking gun with an alternative piston rod-trigger engagement arrangement. In these patented guns the trigger urges the piston rod toward the fluid receptacle by means by a ratchet mechanism. They do not, however, make provisions for biasing the piston rod in the forward direction when the trigger is not in operation.

SUMMARY OF THE INVENTION

Particular arrangements in accordance with the present invention comprise a caulking gun for the dispensing of caulking material commonly used in construction work and repair and remodeling of residential and other buildings. The caulking material is conventionally provided in cylinders or tubes having a hollow tip from which the caulk is extruded by the action of a piston which is advanced from the rear of the tube toward the tip. Caulking guns are designed to hold such a caulking cylinder in a receiver housing, often barrel shaped in the form of a half cylinder, within which there is installed a longitudinally movable rod with a piston member at one end of the rod for extruding the caulking material out of the caulking tube. The caulking gun further includes a handle secured to the receiver housing, a trigger pivotably mounted to the housing so as to cooperate with the handle and a drive mechanism for coupling the trigger to the rod to drive it forward when the trigger is pulled. There is also a mechanism for uncoupling the trigger from the rod when the trigger is released. Through repeated operation of the trigger, the rod and piston member may be advanced in the direction of the caulk tube tip, thereby providing means for dispensing the contents of the caulk tube.

It is a particular feature of the present invention that the caulk gun disclosed herein is provided with a biasing mechanism to relieve the back pressure inside the caulk tube while retaining the rod and piston member in the position attained during a given trigger stroke after the trigger is released. This biasing mechanism includes a member which frictionally engages the rod so as to retain it in its forward position while permitting the rod to be withdrawn rearwardly by sliding it backward past the frictional member when it is desired to install a new tube of caulking material in the caulk tube receiver.

Caulking guns of the type incorporated in the present invention provide for uncoupling the forward drive mechanism from the rod upon release of the trigger so that the pressure which has built up within the caulk tube during the forward advancement of the piston member may be relieved by a slight rearward movement of the piston member and rod. This is desirable in the operation of the caulking gun, since it results in the caulking gun providing a dripless feature whereby the extrusion of caulking material from the tip of the caulk tube is terminated as soon as the trigger is released. Furthermore, the forward-biasing mechanism of the present invention serves to modulate the extent of rearward travel of the piston member, whereby the unintentional release of the caulk tube is prevented.

To accommodate this slight rearward movement of the piston member and rod upon release of the trigger, which may amount to as much as ⅜ of an inch due to the internal pressure of the caulk tube, the frictional engaging member is associated with a biasing spring. During the slight rearward movement of the rod at the end of a trigger stroke, this biasing spring compresses as the frictional engaging member travels rearwardly with the piston member and rod in response to the pressure inside the caulk tube. The frictional member and the biasing spring are contained in a housing which may be mounted at the rear of the trigger housing, or incorporated into the trigger housing construction.

In one particular embodiment, the frictional member may be in the form of a bushing which encircles the rod and frictionally engages it. This frictional engagement can be overcome by manually pulling the rod rearwardly, thereby withdrawing the piston so that a new tube of caulking material may be inserted in the receiver. The bushing is backed by the biasing spring which may be in the form of a coil spring also encircling the rod. The housing containing the bias mechanism may be an open framework, formed from stamped sheet metal or plastic, with an opening in the rearward face thereof through which the rod extends. The spring bears against the inner surface of the rearward face of the housing which provides the backing for the spring to bias the bushing and therefore the rod in the forward direction. This maintains contact of the piston with the caulk tube, and prevents the unintended release of the caulk tube when the rod is released from the trigger-operated driving means.

BRIEF DESCRIPTION OF THE DRAWINGS

A better understanding of the present invention may be realized from a consideration of the following detailed description, taken in conjunction with the accompanying drawings, in which.

DETAILED DESCRIPTION OF THE PREFERRED EMBODIMENT

Figure 1:
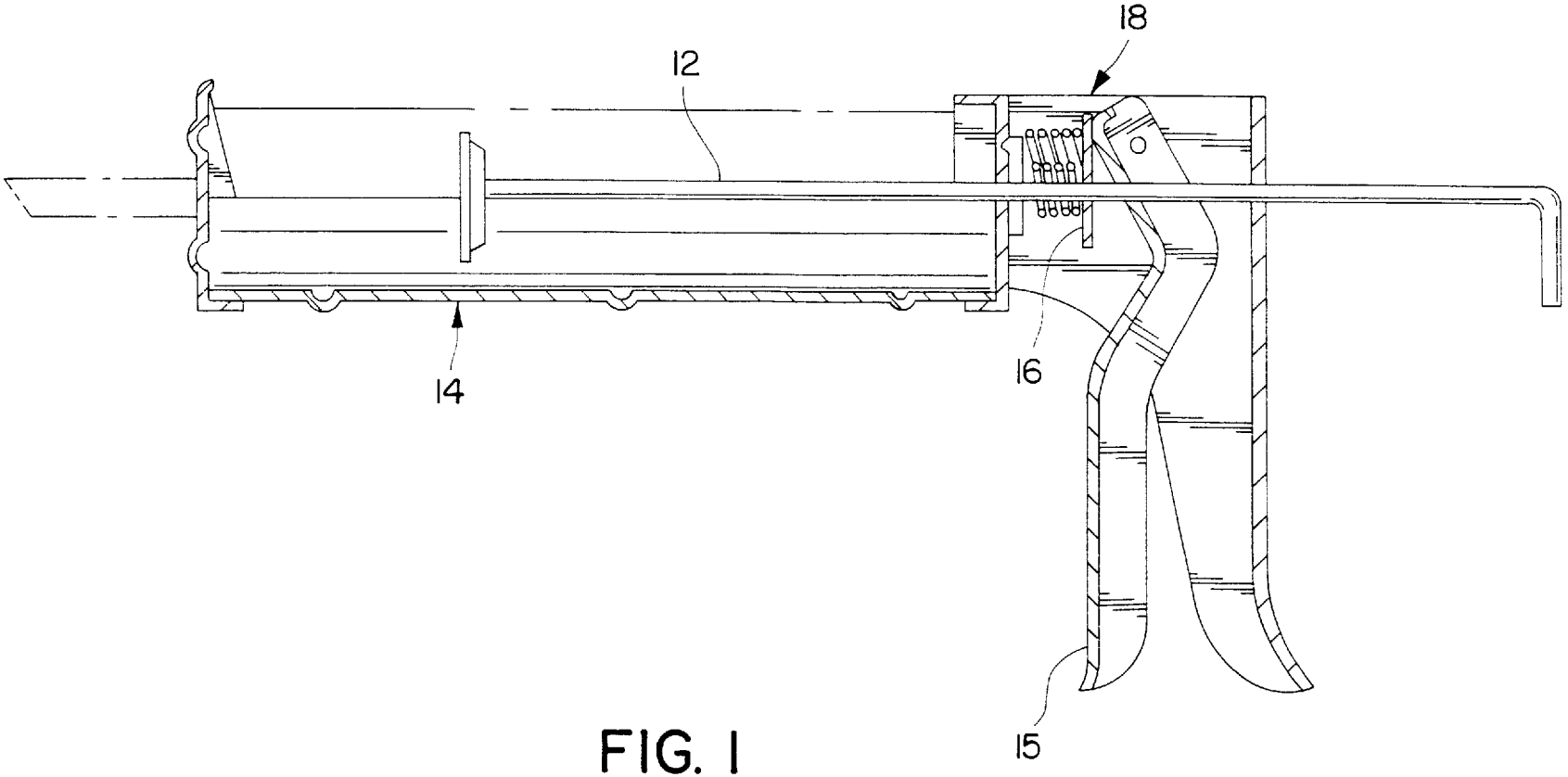
FIG. 1 PRIOR ART
FIG. 1 is a schematic sectional view of a conventional caulk gun of the prior art.

FIG. 1 shows generally a conventional grip type caulk gun of the prior art having a barrel-shaped tube housing or receiver 14 and a trigger housing 18. Passing through these two housings is a piston rod 12, which is advanced in the forward direction (toward the left side of the drawing figure) by action of a trigger 15 to thereby push caulk out of a caulk tube (shown in phantom outline) disposed in the tube housing 14. In operation, a drive grip or drive dog 16, which is disposed in trigger housing 18, is driven forward by the counterclockwise rotation of trigger 15 when the trigger is pulled by the operator. The trigger 15 is biased in the opposite direction by a spring (not shown) which restores the trigger to the cocked position after the application cycle. The drive grip 16, through which piston rod 12 passes, is contacted by the trigger 15 at a position along its length such that it is canted in the forward direction by the force of the trigger. The drive grip 16 then engages piston rod 12 and advances it in the forward direction, thus pushing caulk out of the caulk tube in proportion to the pull on the trigger.

Figure 2:
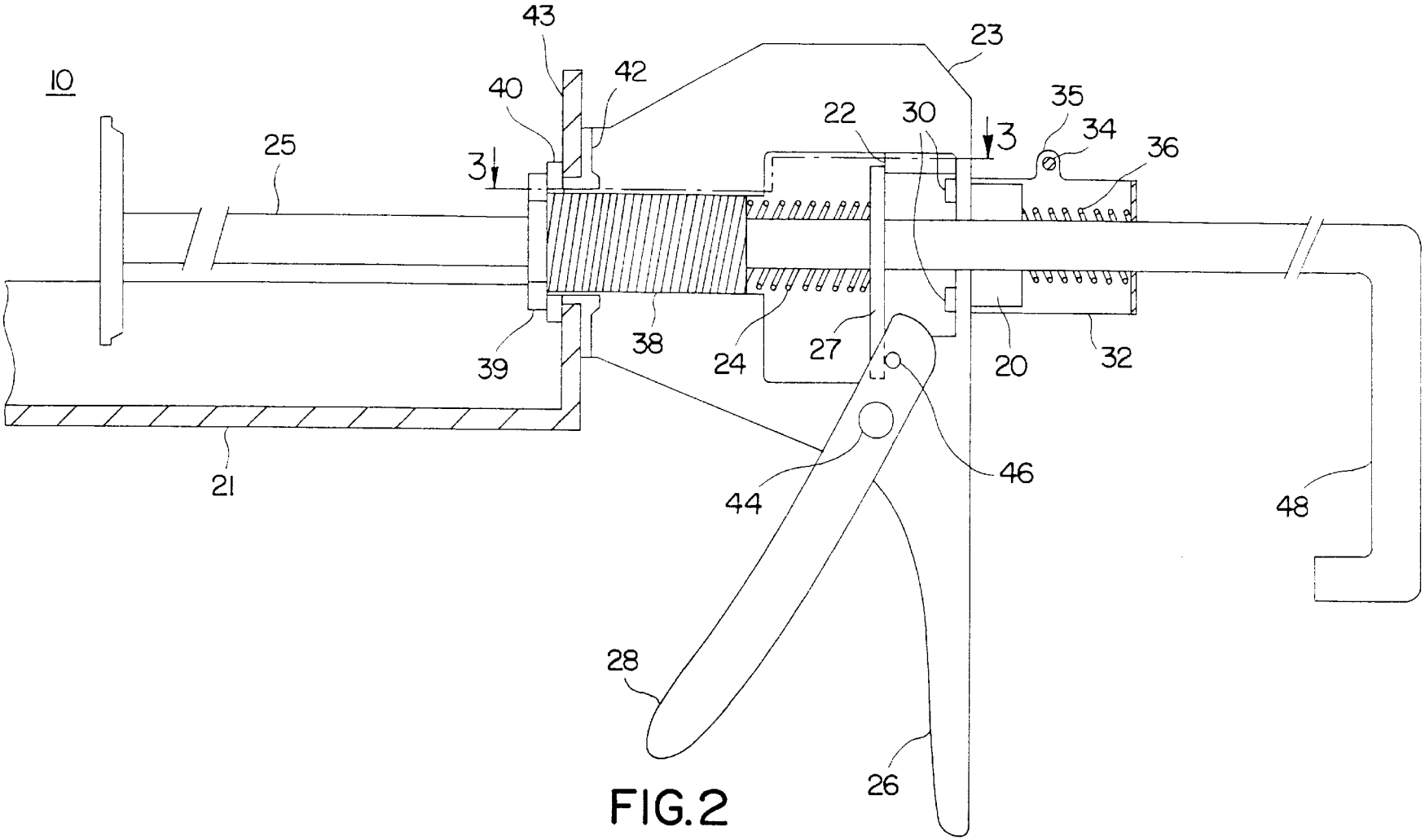
FIG. 2 is a schematic side elevational view of a caulk gun embodying the present invention.
Figure 3:
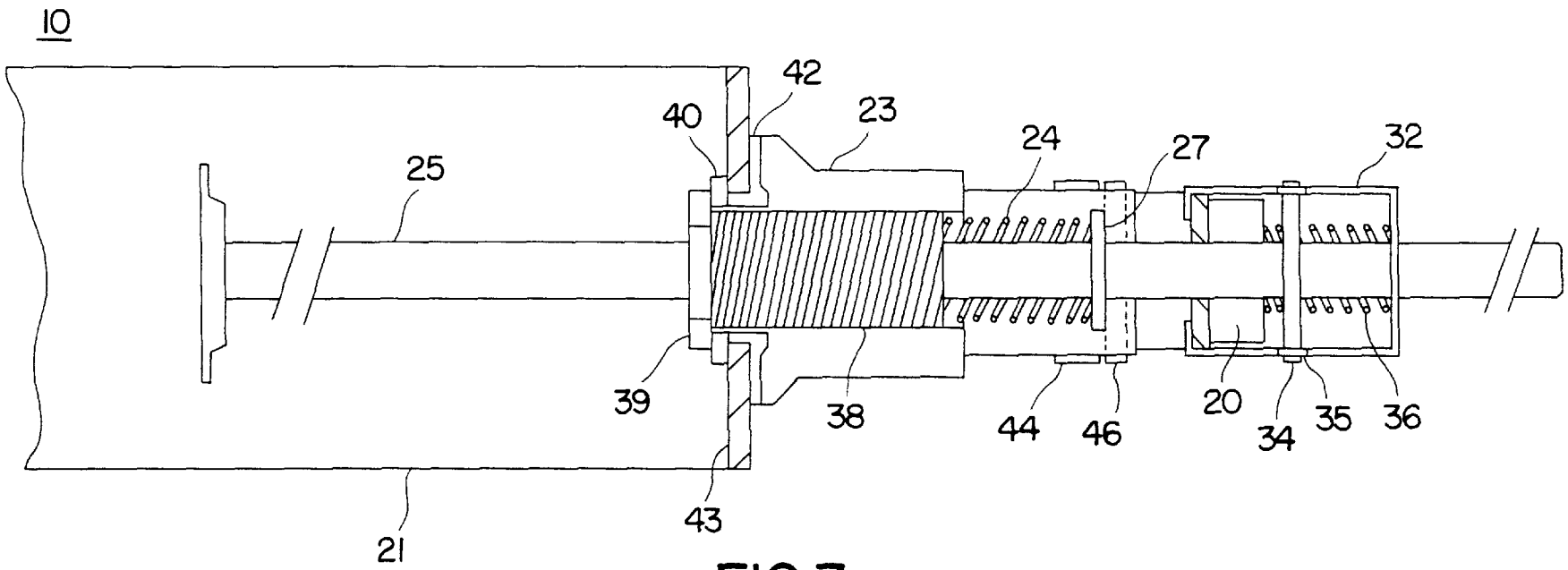
FIG. 3 is a schematic top view of the embodiment of FIG. 2, in partial section taken along the line 3—3.

A preferred embodiment of the invention is shown in the elevational and plan views of FIGS. 2 and 3, respectively. As seen in those schematic, partial sectional views, the caulk gun 10 has a receiver or tube housing 21 for receiving a tube of caulking material (not shown) and an associated trigger housing 23. A trigger 28 is mounted in the trigger housing 23 by a pivot pin 44 and is biased to its clockwise position depicted in FIG. 2 by a biasing spring (not shown). This biasing spring operates to restore the trigger to the cocked position following the application cycle.

Structurally, trigger housing 23 is mounted to tube housing 21 by threaded piston rod guide 38, which rod guide 38 may be provided with a bolt head 39. A spacer 42, comprised of a suitable polymeric material, is provided on one side of tube housing wall 43, while on the other side, a washer 40 may be provided. Trigger housing 23 is formed of a cast material, and trigger 28 can be of a stamped metal. As seen in FIGS. 2 and 3, trigger 28 may be provided with a contact point 46 and rotates about pivot pin 44.

When trigger 28 is released by the operator, spring 24, which was compressed by the advancement of drive grip 27, now presses drive grip 27 backwards (towards the right side of the page). I:n contrast to trigger 28, which only acted on one side of drive grip 27 and thereby caused it to cant and grip piston rod 25, spring 24 acts evenly on drive grip 27, returning it to an upright position and permitting it to slide back along piston rod 25 without gripping the piston rod. Grip 27 thus slides back along piston rod 25, coming to rest against stop 22.

Drive grip 27 is designed of a width suitable to enable gripping of piston rod 25 when canted, by action of trigger 28 against one end thereof, and conventionally may be known as a drive dog. Alternatively, engagement between the drive grip 27 and piston rod 25 may be accomplished by using notches provided along the length of piston rod 25 which engage drive grip 27 in a ratchet arrangement as is also common in the art.

The inventive arrangement of friction grip 20 as illustrated in FIGS. 2 and 3 provides a forward biasing mechanism for piston rod 25. This mechanism, by action of the gripping force of friction grip 20 and resilient force of spring 36, biases the piston rod 25 in the forward direction, preventing it from moving backward more than is required to relieve the pressure in the caulk tube when the trigger is released. In this way, the piston maintains contact with the back of the caulk tube, ready for the next trigger stroke. The friction grip 20 is in the form of a bushing which encircles the piston rod 25 and is in frictional engagement therewith. This frictional engagement can be overcome, when it becomes necessary or desirable to replace the caulk tube, by manually pulling the rod rearward, thereby withdrawing the piston so that a new tube of caulking material may be inserted in the receiver.

A feature of the forward biasing mechanism of the present invention is its simplicity of structure and assembly. Housing 32 may be inexpensively comprised of stamped sheet metal, piggy-backed behind trigger housing 23 using tabs 30, bent inward, to hold the assembly in place. Tabs 30 support housing 32 against trigger housing 23 at its proximal end, while at its distal end housing 32 is supported by the piston rod 25 which passes therethrough. Cross rivet 34 passes through ears 35 projecting from the upper edges of housing 32 and serves to strengthen and secure the sides of housing 32.

Although there have been described hereinabove various specific arrangements of a caulk gun in accordance with the invention for the purpose of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as defined in the annexed claims.

What is claimed is:

1. In a caulking gun having a tube housing for receiving a tube of caulking material, a trigger housing attached to the tube housing, a handle and a cooperating trigger attached to the trigger housing, a piston member attached to a piston rod for driving caulk out of a tube, and a releasable driving means whereby the operation of the trigger toward the handle advances the piston rod and piston member toward the end of the tube housing remote from the trigger housing, thereby pressuring caulk from the caulk tube, a forward-biasing mechanism for gently biasing the piston rod and piston member toward a caulk tube while providing for the relief of pressure inside a caulk tube, said forward-biasing mechanism comprising:

a forward-biasing mechanism housing affixed to the trigger housing;

a friction grip for slidably engaging the piston rod; and spring means for urging said friction grip in the direction of the piston rod advancement.

2. The device of claim 1, wherein said forward-biasing mechanism housing comprises a pair of side walls respectively joined to opposite edges of an end wall remote from said trigger housing, said end wall defining a bore through which the piston rod passes.

3. The device of claim 2, wherein each of said side walls is formed with attaching means for affixing said forward-biasing mechanism housing to the trigger housing.

4. The device of claim 3, wherein said attaching means comprise at least one tab extending into engagement with said trigger housing.

5. The device of claim 2, wherein said trigger housing has a rear wall defining a transverse space and a bore through which the piston rod extends and wherein said side walls each include a pair of tabs spaced along opposite sides of a U-shaped opening.

6. The device of claim 5, wherein said tabs are bent inwardly to engage the rear wall of said trigger housing.

7. The device of claim 5, wherein said forward-biasing mechanism housing further comprises cross support means extending between and engaging said side walls to retain said tabs in engagement with the rear wall of said trigger housing.

8. The device of claim 7, wherein said side walls each include an ear projecting from said side walls and defining openings for receiving and retaining said cross support means.

9. The device of claim 8, wherein said cross support means comprise a rivet extending through said openings in said ears, said rivet comprising a head on one end and being swaged at its other end to retain the position of said side walls against spreading apart, thereby maintaining said tabs in fixed engagement with said trigger housing.

10. The device of claim 5, wherein said friction grip comprises a generally cylindrical sleeve member having internal and external diameters, said sleeve member encircling the piston rod within said forward-biasing mechanism housing adjacent to and forward of said spring means.

11. The device of claim 10, wherein said sleeve member is biased into contact with the rear wall of the trigger housing during advancement of the piston rod and the piston member.

12. The device of claim 10, wherein said sleeve member is adapted to maintain sufficient frictional engagement between the internal diameter and the piston rod to maintain the piston rod and piston in engagement with the caulking material tube housing against the force of gravity when the gun is oriented with the piston rod vertical and below the piston.

13. The device of claim 2, wherein said forward-biasing mechanism housing is formed of stamped sheet metal.

14. The device of claim 2, wherein said spring means comprises a coil spring surrounding the piston rod in position to bear against the end wall of the forward-biasing mechanism housing and urge the friction grip toward the trigger housing.

15. The device of claim 14, wherein said coil spring is compressible to permit limited retraction of the friction grip during release of the driving means from the piston member.

16. The device of claim 1, wherein said friction grip comprises a bushing defining an internal bore through which the piston rod passes, said bushing being positioned inside said forward-biasing mechanism housing adjacent to and forward of said spring means.

* * * * *